United States Patent [19]

Bergstrom et al.

[11] 4,349,050

[45] Sep. 14, 1982

[54] BLAST JOINT FOR SUBTERRANEAN WELLS

[75] Inventors: Arthur E. Bergstrom, Montgomery; Richard H. Nelson, Houston, both of Tex.; George P. Maly, Fullerton, Calif.

[73] Assignee: Carbide Blast Joints, Inc., Houston, Tex.

[21] Appl. No.: 190,089

[22] Filed: Sep. 23, 1980

[51] Int. Cl.[3] ..... F16L 55/00

[52] U.S. Cl. ..... 138/147; 138/109; 138/145; 138/155; 138/DIG. 6; 138/DIG. 7; 166/243; 285/333; 285/323; 403/366; 403/371; 403/372

[58] Field of Search ..... 138/155, 147, 154, DIG. 6, 138/DIG. 7, 109, 145; 166/243; 285/45, 322, 323, 333, 334; 403/342, 366, 370, 371, 374, 314; 279/41, 42

[56] References Cited

U.S. PATENT DOCUMENTS

| | | | |
|---|---|---|---|
| 3,817,805 | 6/1974 | Surikov et al. | 138/155 X |
| 3,895,832 | 7/1975 | Ellis et al. | 285/322 |
| 4,028,796 | 6/1977 | Bergstrom | 138/155 X |
| 4,141,386 | 2/1979 | Bergstrom | 138/147 |
| 4,160,608 | 7/1979 | Derner et al. | 403/342 X |
| 4,211,440 | 7/1980 | Bergstrom | 138/147 X |
| 4,277,197 | 7/1981 | Bingham | 403/342 X |

FOREIGN PATENT DOCUMENTS

| | | | |
|---|---|---|---|
| 868122 | 4/1971 | Canada | 279/42 |

*Primary Examiner*—Steven L. Stephan
*Assistant Examiner*—Daniel P. Stodola
*Attorney, Agent, or Firm*—Fischer, Tachner & Strauss

[57] ABSTRACT

This is an improved blast joint for subterranean wells which is ideally suited for applications where corrosive compounds such as hydrogen sulfide and carbon dioxide are encountered. The blast joint comprises a plurality of temperature and corrosion resistant hard rings which are in a stacked end face-to-face array, coaxially carried on a length of tubing. The rings are resiliently compressed in the array by spring washers interspaced by flat washers and this assembly is retained by end collars distally carried on the tubing. The end collars which are employed in this invention have a collet type construction; each collar comprising a clamp ring slidably received over the end of the production tubing, having an internally threaded outer end and a tapered inside wall. A collet sleeve with a tapered outside wall is received in the clamp ring. The collar also includes an externally threaded bushing which is received in the threaded outer end of the clamp ring and serves as an axial stop for the collet sleeve as the clamp ring is tightened, compressing the collet sleeve about the outer surface of the tubing, firmly locking the assembly. All members of the collar are coated with a protective, corrosion resistant coating and the gripping surfaces of the collet sleeve are coated with a resin that is filled with angular granular material of a high hardness.

11 Claims, 4 Drawing Figures

Fig. 1
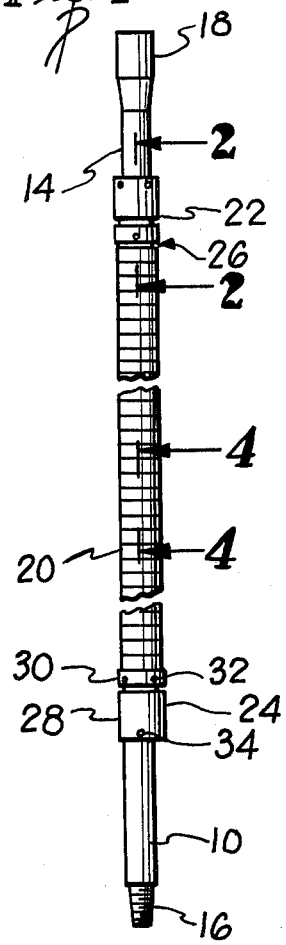
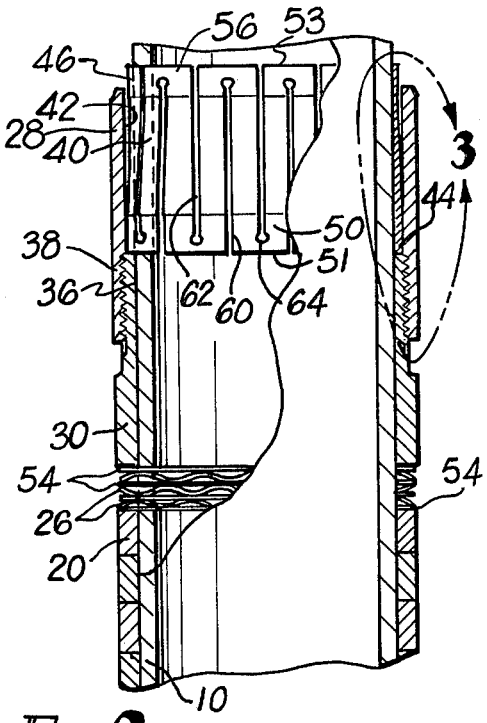
Fig. 2
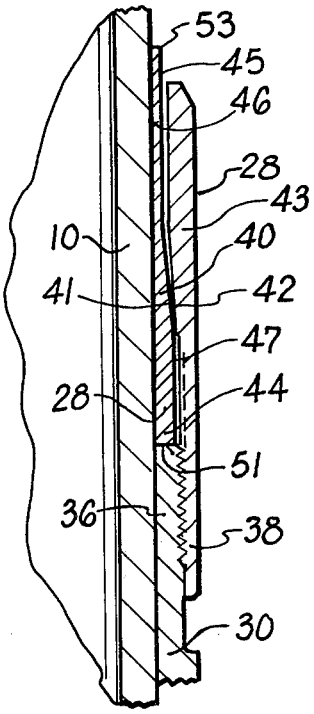
Fig. 3
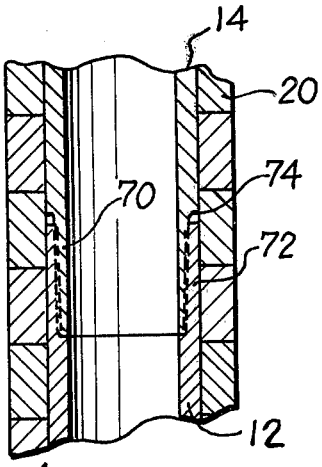
Fig. 4

BLAST JOINT FOR SUBTERRANEAN WELLS

BACKGROUND OF THE INVENTION

The production of oil and/or gas in subterranean wells frequently encounters extreme erosion, experienced when oil or gas escapes from the formation at a high velocity, carrying with it entrained abrasive solids such as silt, sand, clay and clay sized debris. The resultant blast can quickly cut through metal surfaces such as the well tubing, and erosion resistant blast joints have been developed for this application.

In prior U.S. Pat. Nos. 4,028,796 and 4,141,386 there is disclosed a blast joint which is formed with a plurality of cemented tungstun carbide rings stacked in an end face to face array on a string of production tubing. The rings have lap finished end surfaces and are compressed in the assembly by resilient spring washers with the entire assembly retained by collars distally carried on the length of tubing. The collars are slidably received over the tubing and are secured in place by a plurality of set screws which, when tightened, project into binding engagement with the production tubing. This construction has successfully prevented erosion of the production tubing, however, it is not well suited for applications in extremely corrosive environments such as when hydrogen sulfide, carbon dioxide, etc. are encountered. When such corrosive products are encountered, corrosion can occur and this corrosion is concentrated at stress points such as the points of engagement of the set screws with the production tubing or the set screws themselves, releasing the assembly.

BRIEF SUMMARY OF THE INVENTION

This invention comprises a blast joint of improved construction which is ideally suited for applications encountering extreme erosive and corrosive attack. The blast joint of this invention utilizes the wear rings in a stacked, end face to face array, resiliently compressed by spring washers and secured by locking collars on a length of production tubing. The locking collars which are utilized in this invention are of a collet type construction, each locking collar formed with an internally threaded clamp ring with an inner tapered wall, a collet sleeve having a tapered outer side wall and a plurality of longitudinal slots extending, alternately from opposite ends thereof and received within the clamp ring, and an externally threaded bushing threadably received within the clamp ring. The collar is slidably received on the production tubing so that the rotation of the clamp ring relative to the bushing compresses the collet sleeve against the sidewall of the production tubing, locking the assembly. The joint members are coated with a protective, corrosion resistent coating and the gripping surfaces of the collet sleeve are coated with a coating filled with granular material of a high hardness and a limited size range.

BRIEF DESCRIPTION OF THE DRAWINGS

The invention will be described with reference to the figures of which:

FIG. 1 is a view of a blast joint according to the invention;

FIG. 2 is a longitudinal axial view in partial section on line 2—2 of FIG. 1;

FIG. 3 is an enlarged sectional view along line 3—3 of FIG. 2; and FIG. 4 is a longitudinal axial section along line 4—4 of FIG. 1.

DESCRIPTION OF THE PREFERRED EMBODIMENT

The blast joint shown in FIG. 1 is positioned around a section 10 of the production tubing at the location subjected to severe erosive and corrosive conditions. This tubing section 10 has, at opposite ends, a conventional threaded pin joint 16 and threaded box joint 18 to permit assembly in a string of production tubing used in subterranean wells. When the blast joint is to extend a distance greater than a single section of tubing (which is about 30 feet), the section 10 can be formed of two segments which are joinded at an intermediate portion of their length, as described hereinafter.

A plurality of rings 20 are assembled on the section 10 of production tubing in end face-to-face array. These rings fit snugly on the production tubing. The rings are formed of a very hard and abrasive resistant material, preferably of tungsten carbide powders which are cemented into a homogeneous solid according to conventional technology. The ends of the rings are lap finished and the assembly is maintained under compression by end collars 22 and 24, each carried on the tubing section and a plurality of wave spring washers generally indicated at 26. Typically these rings have an axial length of 0.5 to 1.5 inch, usually about 1.0 inch.

Each of the locking collars such as 24 is formed of a clamp ring 28 and a clamp bushing 30 which are threadably interengaged and, for this purpose, have a plurality of apertures 32 and 34 to receive teeth of a spanner or wrench to permit tightening of their threaded engagement.

Referring now to FIGS. 2 and 3, the construction and function of the locking collars will be described in greater detail. As shown in FIG. 2, the section 10 of the production tubing slidably receives bushing 30 and the clamp ring 28 which are threadably engaged with the externally threaded neck 36 of bushing 30 received in the internally threaded end 38 of clamp ring 28. A collet sleeve 40 is also slidably received over the production tubing and this sleeve is received within clamp ring 28. The latter has a tapered internal side wall 42 which coacts with collet sleeve 40 to compress the latter as the clamp ring is moved longitudinally relative to the sleeve. The sleeve 40, for this purpose, has a side wall also of tapered configuration with its thickest wall end 44 adjacent the end of clamp bushing 30 and the thinest wall at its opposite end 46. The taper of the inside side wall of the clamp ring is illustrated in the enlarged sectional view of FIG. 3 where the section 43 is shown with a taper. FIG. 3 also shows that the collet sleeve 40 has a tapered side wall 41 intermediate straight wall portions 45 and 47.

Referring to FIG. 2, the configuration of the collet sleeve is shown in greater detail. As illustrated, a portion 50 of the collet sleeve 40 is shown in unrelieved section. The collet sleeve thus illustrated has its innermost, thick, edge 51 bearing against collet bushing 30 which bears against the stack of flat and wave spring washers 26. Flat washers 54 are placed at opposite ends of the stack and between groups of up to four wave spring washers 26. The opposite and thinner edge 53 of the collet sleeve 40 extends from the opposite end of the clamp ring 28. The collet sleeve 40 is provided with a plurality of longitudinal grooves such as 60 and 62 extending, alternately, from opposite edges of the collet sleeve 40 and terminating in enlarged diameter apertures 64 which serve as stress relievers. This construction provides a significant radial compressibility of the collet sleeve 40 permitting it to exert a clamping force on the tubing which it encircles as the bushing 30 and clamp ring 28 are tightened.

The locking collars are assembled to the tubing to place the wave spring washers 26 under compression. This is accomplished by firmly locking one collar to the tubing 10 and positioning the other locking collar on the opposite end of the assembly under a compressive force. For this purpose, a clamping ring is temporarily placed on the tubing and used to force the second locking collar towards the assembly, compressing the spring washers 26. Then the bushing is held stationary and the clamp ring is turned to compress the collet sleeve against the tubing. Once thus secured, the clamping ring can be removed.

The spring washers which are preferred are the illustrated wave spring washers. Any other spring washers such as Belleville spring washers can also be used, if desired.

Referring now to FIG. 4, there is illustrated a section of an intermediate portion of a blast joint having a length in excess of that of a tubing section, i.e., in excess of about 30 feet. In this blast joint, two segments 12 and 14 of production tubing are prepared by cutting the pin and the box end from respective lengths of production tubing. The resultant segments are joined, as shown in FIG. 4 in a flush pin and box joint by forming a threaded pin end 70 on segment 14 which is received on a coacting threaded box end 72 of segment 12 by forming a flush joint 74 there between.

All of the surfaces of the spring washers and the locking collar member, i.e., the clamp ring, the clamp bushing and the collet sleeve are coated with a suitable corrosion resistant plastic film which can withstand the elevated temperatures expected to be encountered in subterranean wells. Such temperatures can be ambient to 650° F.; and corrosive compounds including hydrogen sulfide, carbon dioxide, hydrochloric acid, hydrofluoric acid and the like can be encountered. While various heat resistant plastic materials such as polyimides, fluoroplastics, etc., can be used for this purpose, it has been found that polyphenylene sulfide coatings are by far superior to other plastic resins, because of the very high temperature and high corrosion resistence of this polymer. Polyphenylene sulfide is a crystalline aromatic polymer having alternating sulfur atoms and para-substituted benzene rings which provide it with a very crystalline structure, imparting a high melting point and high thermal stability and excellent corrosion resistance. The coatings of this resin can be applied as powders by flocking, electrostatically coating or application of a slurry of the powder. The coated products are baked at suitable temperatures and for a time sufficient to fuse the applied powders into a coherent film coating.

In accordance with the invention, the inside surfaces of the collet sleeve, which engage the production tubing, are coated with a resin which incorporates granular particulate solids having a high hardness and a particle size which is from ½ to about 3 times the thickness of the applied resin coating. Commonly, the resin coating is from 2 to about 5 mils in thickness. When the production tubing 10 which is received within the locking collars is also coated with a resin for corrosion resistant, the average particle diameter of the granular particles used in the resin coating the inside surface of the collet sleeve should be from 1 to about 3 times the sum of the thicknesses of the coatings on the collet sleeve and on the production tubing.

Useful solids for this application are those having a hardness from about 6 to 10 Mohs scale. These are abrasive materials and include natural materials such as diamonds, corundum, emery, flint, quartz and garnet, and synthetic materials such as synthetic diamonds, alumina, tungsten, titanium, silicon or boron carbides, and boron nitride.

The quantity of the granular solids incorporated in the resin can be from 10 to about 70 weight percent, preferably from 20 to about 50 weight percent of the resin. Although any of the aforementioned solids which can be used for this purpose, silicon carbide and vitrified alumina are preferred for their high hardness and availability.

The invention has been described with reference to the illustrated and presently preferred embodiments. It is not intended that the invention be unduly limited by this disclosure of the preferred embodiments. Instead, it is intended that the invention be defined by the means, and their obvious equivalent, set forth in the following claims:

What is claimed is:

1. In a blast joint for a tubing wherein a plurality of heat abrasive resistant wear rings, each having substantially planar end faces, are coaxially mounted in end face-to-face array on said tubing and are resiliently compressed thereon by axial spring means, the improvement comprising:

a pair of spaced annular clamping collars distally and coaxially carried on said tubing and retaining said wear rings and spring means therebetween, each of said collars including a collet joint formed by an internally threaded clamp ring having a tapered inside wall, an expandible clamping sleeve having a tapered outside wall received within said clamping ring and having a plurality of longitudinal slots extending from at least one end partially along the length thereof, and an externally threaded clamp bushing having an inside shoulder bearing against the end of said expanding clamping sleeve and threaded into said clamp ring to advance said expanding clamping sleeve in said ring and compress said expanding clamping sleeve against said tubing.

2. The blast joint of claim 1 wherein said clamp bushing, clamping sleeve and clamp ring are coated with a protective resin.

3. The blast joint of claim 2 wherein said protective resin is polyphenylene sulfide.

4. The blast joint of claim 3 wherein the inside annular wall of said clamping sleeve is coated with a resin containing from 5 to about 70 weight percent of a granular solid having a maximum particle diameter no greater than about ½ to 5 times the thickness of said resin coating and a hardness from about 6 to 10 Mohs scale.

5. The blast joint of claim 4 wherein said granular solid has an angular, sharp-edged particle shape.

6. The blast joint of claim 5 wherein said granular solid is a naturally occurring abrasive.

7. The blast joint of claim 6 wherein said solid is diamond, corundum, emery, flint, quartz or garnet.

8. The blast joint of claim 5 wherein said granular solid is a synthetic abrasive.

9. The blast joint of claim 8 wherein said solid is diamond, alumina, tungsten carbide, titanium carbide, silicon carbide, boron carbide or boron nitride.

10. The blast joint of claim 5 wherein said granular solid is silicon carbide or tungsten carbide.

11. The blast joint of claim 5 wherein said granular solid is vitrified aluminum.

* * * * *